United States Patent [19]

Sutton

[11] 4,426,989

[45] Jan. 24, 1984

[54] BOW STRING RELEASE

[75] Inventor: Richard M. Sutton, Fridley, Minn.

[73] Assignee: Sutton and Thayer, Fairmont, Minn.; part interest to each

[21] Appl. No.: 249,750

[22] Filed: Apr. 1, 1981

[51] Int. Cl.[3] ..... F41B 5/00

[52] U.S. Cl. ..... 124/35 A

[58] Field of Search ..... 124/35 A, 41 A, 90, 124/35 R

[56] References Cited

U.S. PATENT DOCUMENTS

| | | | |
|---|---|---|---|
| 2,929,372 | 3/1960 | Vance | 124/35 A |
| 2,996,059 | 8/1961 | Vance | 124/35 A |
| 3,028,852 | 4/1962 | Sutton | 124/35 A |
| 3,072,115 | 1/1963 | Johnson | 124/35 A |
| 3,800,774 | 4/1974 | Troncoso | 124/35 A |

*Primary Examiner*—Richard J. Apley
*Assistant Examiner*—William R. Browne
*Attorney, Agent, or Firm*—Hugh D. Jaeger

[57] ABSTRACT

Bow string release for use by an archer with a bow and arrow for pulling a bow string through the center of the hand by engaging the bow string with an eyed string of the bow string release at a predetermined position for precise shooting of an arrow. The bow string release includes two degrees of freedoms with orthogonally positioned pivot points. The release mechanism is a threaded hook member in cooperating with an eyed string at one of the pivot points which captures the bow string. The pivoted hook-eyed string mounts on a plate which pivots about a wrist strap. The wrist strap including a roller clasp, positions over an archers thumb, across the palm of his hand, and secures in position with a strap having a plurality of holes through the roller clasp. The bow string release is actuated by removing the thumb which results in pivoting of the hook-eyed string member such that the force of the bow string pivots the hook-eyed string about the pivot point for subsequent release of the eyed string thereby releasing the drawn bow string for flight of the arrow. An alternative embodiment includes a wrist strap having a threaded member secured at a forward position on the wrist strap for attachment of other bow string release structures.

5 Claims, 10 Drawing Figures

FIG. 1
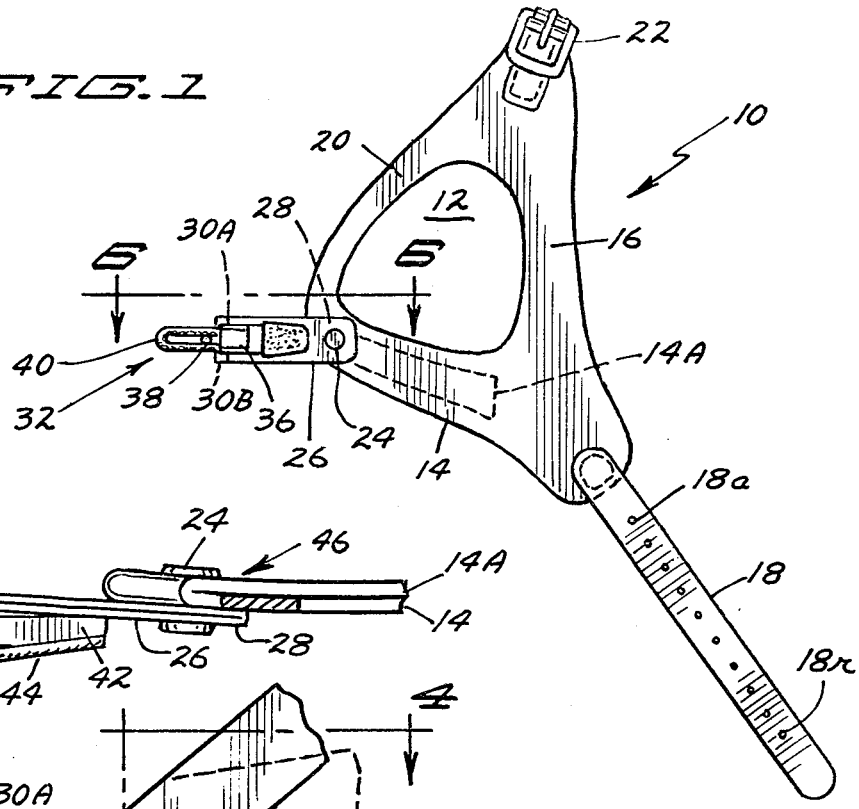
FIG. 2
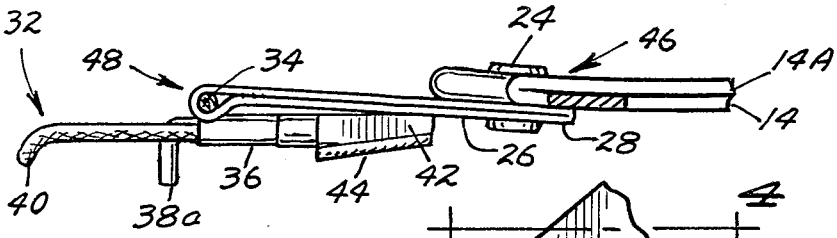
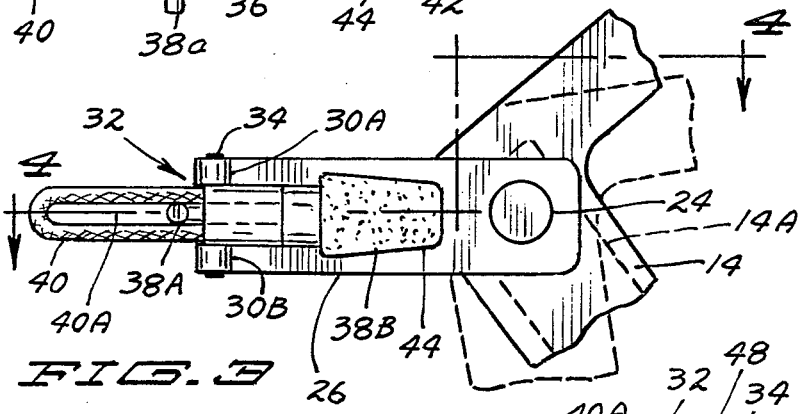
FIG. 3
FIG. 4
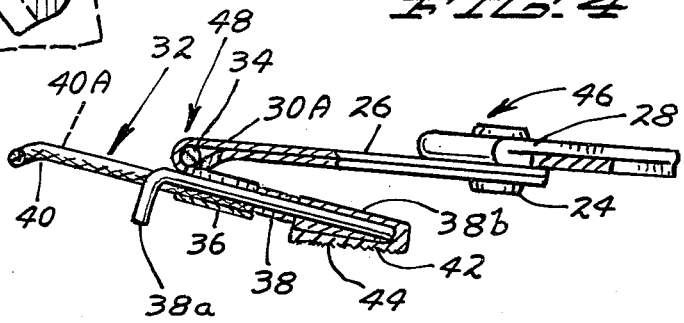
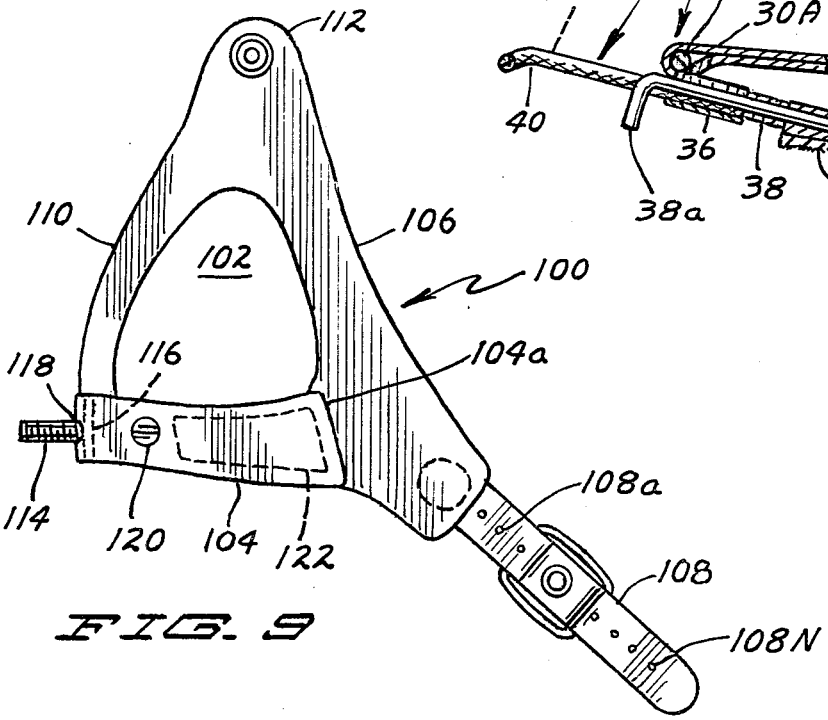
FIG. 9
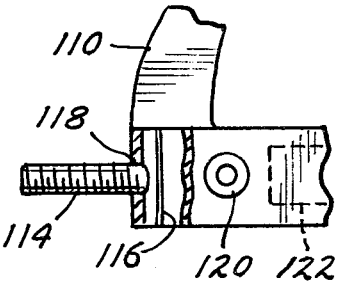
FIG. 10

BOW STRING RELEASE

BACKGROUND OF THE INVENTION

1. Field of the Invention

The present invention relates to archery, and more particularly, pertains to a bow string release.

2. Description of the Prior Art

There are numerous types of releases, mechanical and non-mechanical, in the prior art. Mechanical releases are unsatisfactory for hunting and other types of archery as being prohibited by law for hunting and by archery organization regulations for competition shooting. Non mechanical releases have included a number of different designs which are uncomfortable to wear and non-practical in use.

Another type of bow string pulling device for archers is illustrated in U.S. Pat. No. 3,028,852, which is worn on the archers string pulling hand and facilitates the gripping of the bow string for achieving a smooth fast release of the bow string for precise flight of the arrow to the target.

The present invention provides a bow string release which overcomes the disadvantages of the prior art and provides a bow string release with precise releasing structure over two degrees of freedom.

SUMMARY OF THE INVENTION

The general purpose of the present invention is to provide a bow string release for archers such as the bow hunter, field archer, target archer, and other archers which provide a fast, smooth and accurate and predetermined release at each time the bow string is drawn. The advantage of the bow string release is that the pulling power is transferred to the shoulder instead of the fingers and forearm and is especially advantageous for individuals who are handicapped and missing fingers or with damaged fingers. The bow string release is on an adjustable wrist strap which can be used by any sized individual and is constructed for left-handed as well as right-handed individuals.

According to one embodiment of the present invention, there is provided a bow string release for use with a bow string of a bow through which the archer's hand fits and is actuated by the archer's thumb for propelling an arrow to a predetermined target, the bow string release including a strap having a hand strap, a front wrist strap, a rear wrist strap with a plurality of holes, a cross strap, and a roller clasp positioned between the front wrist strap and the cross strap for securing the strap in the configuration of a closed y over the thumb and across the palm of an archer's hand at the wrist, a pivot pin positioning a steel plate at a first movable degree of freedom at the junction of the hand strap and cross strap, steel plate including two opposing and aligned pivot holes, a release mechanism positioned on a pin, the pin rotatably mounted between the two pivot holes at a second degree of freedom, a press sleeve positioned on the pin and holding a right angled hook having threads at one end and an eyed loop of string, a threaded thumb plate secured to the threaded end of the pin and having a pad such as Velcro or felt secured thereto whereby the eyed string loops around the bow string below the nocking point and the eyed end of the string loops over the hook for pulling of the bow string and is held in position of the archer's thumb holding the thumb plate against the plate for subsequent drawing of the bow string back to a predetermined point for subsequent release thereby shooting the arrow to the predetermined target.

A significant aspect and feature of the present invention is the bow string release which increases the speed of the arrow in the range of 5–12% by the new bow string release. The release allows for instant departure and acceleration of the bow string with negligible to infinitesimal friction. The faster clean release of the bow string results in a higher velocity of the arrow at increased acceleration at departure from the string.

Another significant aspect and feature of the present invention is a bow string release which covers every phase of archery including target, field, hunting, etc. and can be utilized by either right or left-handed archers. The bow string release also will fit over gloves in the event of cold temperatures or depending upon an archer's preference for wearing gloves.

Another significant aspect and feature of the present invention is a bow string release where the bow string release can be utilized by individuals with missing or damaged fingers. This provides that an individual can shoot a bow and participate in archery. A further significant aspect and feature of the present invention is a bow string release where the pulling power is transferred to the shoulder instead of the fingers and forearms as with the previous prior art devices. The bow string release also has two degrees of freedom never before heard of in the prior art, which allows that the bow string release can inherently adjust to shooter's hand, arm and body positions.

Having thus described the invention, the principle object hereof to provide a bow string release for archery.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 1 illustrates a front view of a bow string release;

FIG. 2 illustrates a sectional view taken along line 2—2 of FIG. 1;

FIG. 3 illustrates an exploded view of a release structure of the bow string release;

FIG. 4 illustrates a sectional view taken along line 4—4 of FIG. 3;

FIG. 9 illustrates an alternative embodiement of a bow string strap; and,

FIG. 10 illustrates an exploded view of attachment structure of the bow string strap.

DESCRIPTION OF PREFERRED EMBODIMENTS

Figure 5:
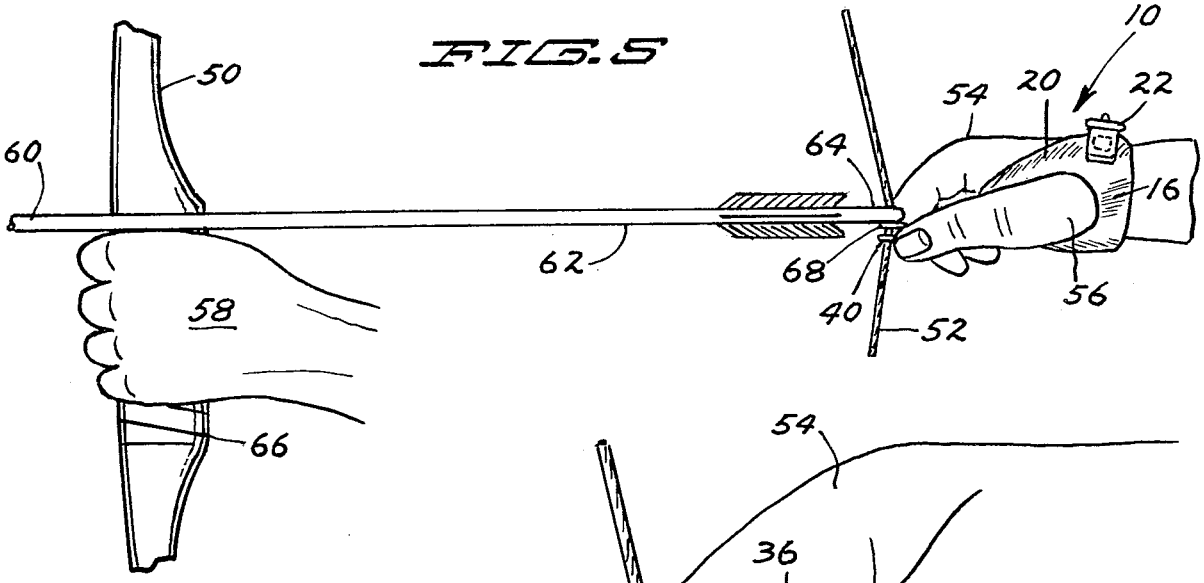
FIG. 5 illustrates the bow string release being utilized by an archer in shooting an arrow by a bow.

FIG. 1, which illustrates a front view of a bow string release 10, the present invention, shows a strap assembly 12 including a hand strap 14, the front wrist strap 16, the rear wrist strap 18, including a plurality of holes 18A through 18N, and a cross strap 20, which forms a closed "Y" and is worn on the archer's string pulling hand when positioned as shown in FIGS. 5–8 for gripping of the bow string and achieving a smooth and accelerated release of the bow string. A roller clasp 22 secures at the junction of the front wrist strap 16 and the cross strap 20, and the rear wrist strap 18 secures at the junction at the hand strap 14 and the front wrist strap 16. A portion of the hand strap 14 is doubled over at 14A is illustrated in dash lines for further reinforcing the securing of a pivot pin 24. A steel plate 26 longitudinal and doubled in size is rotatably positioned about the pivot pin 24 at a hole 28 in the pivot pin at one end and includes two opposing aligned pivot holes 30A and 30B in the other end is also illustrated in FIGS. 2,4,7 and 8 and provides a first degree of freedom. A pin 34 rotatably mounts in the pivot hole 30A and 30B and provides a second degree of freedom for the release of structure 32. The release structure 32 includes a right angled threaded hook member 38 having a right angled hook 38A and a threaded end 38B which positions inside a press sleeve 36 along with a piece of eyed string 40 where the sleeve 36 is affixed to the pin 34 at a substantially right angle by welding, soldering or other suitable attachment. A thumb plate 42 illustrated in FIG. 2 having a felt or Velcro covering 44 threads on to the threaded end 38B of the hook 38.

FIG. 2, which illustrates a sectional view taken along line 2—2 of FIG. 1, shows structure including numerals which correspond to those elements previously described. The first degree of freedom 46 and second degree of freedom 48 in a rest position or at right angles to each other but provide for movement of the bow string release 10 through three degrees of geometry.

FIG. 3, which illustrates an exploded view of the release structure, shows numerals which correspond to those elements previously described. The figure specifically shows that the plate and strap 12 are removable with respect to each other where the strap is shown moved and in dash lines.

This movement is illustrated of the pivoting of the first degree of freedom 46.

FIG. 4, which illustrates a sectional view taken along line 4—4 of FIG. 3, shows numerals which correspond to those elements previously described. More particularly though, pivoting at the pin 34 and second degree of freedom 48 is illustrated most explicitly which also occurs at release of the bow string between the eyed loop 40A of the string 40 separating from the right angled end 38A of the hook 38.

MODE OF OPERATION

Figure 6:
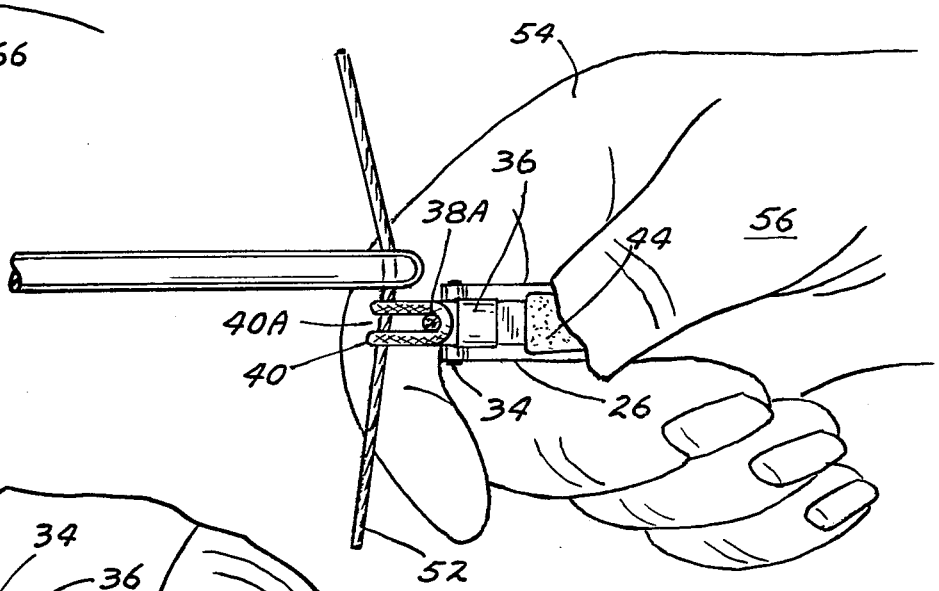
FIG. 6 illustrates a close-up view of the bow string release capturing the bow string.
Figure 7:
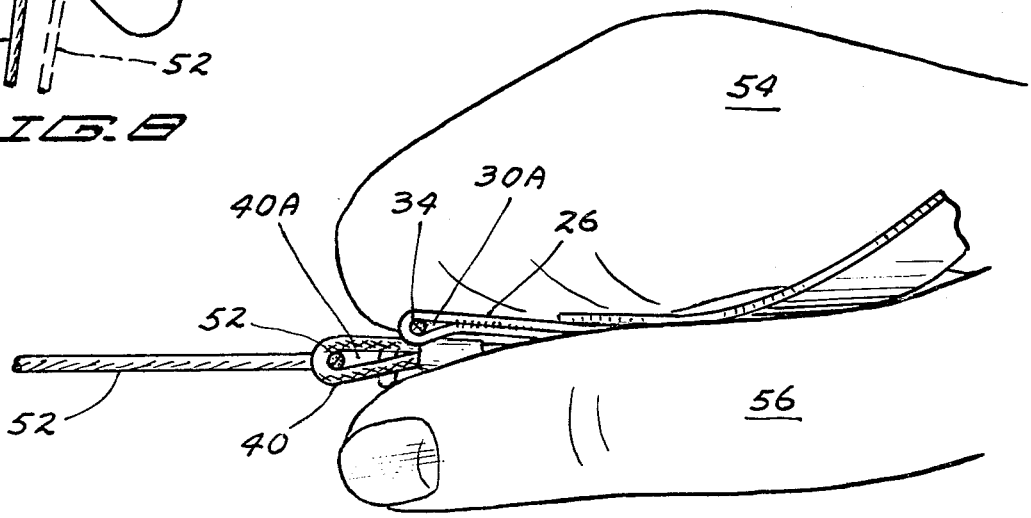
FIG. 7 illustrates a top view of FIG. 5.

FIGS. 5–8 illustrate the operation of the bow string release 10. The bow string release 10 is positioned on the archer's hand, whether it be the archer's right hand 54 as illustrated in the figure, or in the alterntive the archer's left hand for a left-handed person, and strapped in place with the rear wrist strap 18 through the roller clasp 22. The eyed string 40 is positioned about the bow string 52 just below the nocking point 68 and looped over the hook 38A. The thumb 56 of the archer positions over the pad 44. Subsequently, an arrow 60 is positioned above the nocking point 68 so as to engage the nock 64 in the bow string 52. The archer's left hand 58 is positioned over the grip 66 of the bow 50 and the archer's right hand 54 is pulled backwardly through the action of the archer's wrist through the center of the hand. This pulling action and gripping action of the pad 44 is also illustrated in FIG. 6 as well as FIG. 7. FIG. 6 shows a close-up exploded view of the bow string release with the thumb partially cut away, and FIG. 7 shows a top view of FIG. 5. The two pivot points at pivot pin 24, the first degree of freedom 46, and pivot holes 30 acting in cooperation with pin 34 at the second degree of freedom 48 provide the two degrees of freedom with three dimensional movement of the bow string release as illustrated in the figures.

Figure 8:
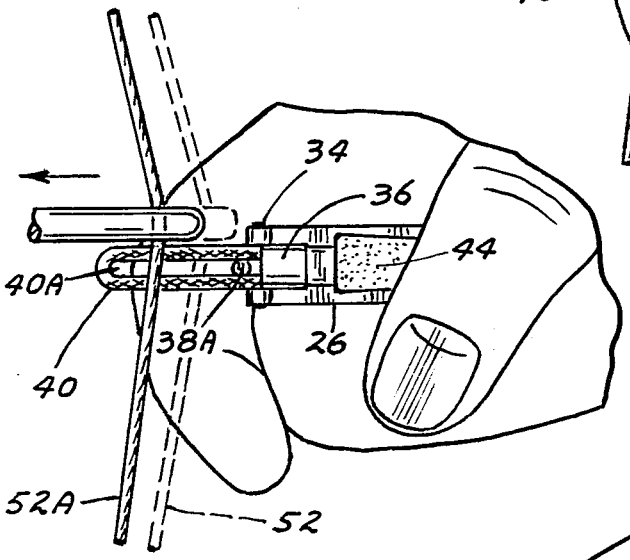
FIG. 8 illustrates release of the bow string by the bow string release.

The release of the bow string 52 is accomplished by moving the thumb 56 away from the pad 44 over the thumb plate 42 resulting in the force of the bow string causing movement about the second degree of freedom 48 at the pin 34 rotatably moveable in the pivot holes 30A and 30B causing the hook 38 to rotate releasing the eyed string 40 as illustrated in FIG. 4 with final release of the bow string moving forward as illustrated in FIG. 8.

ALTERNATIVE EMBODIMENT

FIG. 9, which illustrates an alternative embodiment of a bow string strap, shows a bow string strap 100 including a hand strap assembly 102 having a hand palm strap 104, a front wrist strap 106, a rear wrist strap 108 including a plurality of holes 108A–108N, and a cross strap 110 which forms a closed "Y" and is worn on the archer's string pulling hand when positioned as illustrated in the other figures for the embodiment of FIGS. 1–8. A roller clasp 112 secures at the junction of the rear wrist strap 108 and the cross strap 110. A portion of the hand strap 104 is doubled over at 104A providing for further strength and capture of threaded member 114 as now described in detail.

A threaded member 114 having a "T" 116 at the top of the member positions through a hole 118 of the hand strap 104 and is secured therein by a rivet 120. A stitch in the form of a rectangle 122 is illustrated in dashed lines. The threaded member 114 provides for any type of release mechanism to be screwed onto the hand strap assembly 102.

FIG. 10, which illustrates a cutaway exploded view of the bow string strap 100 at the section of the threaded member 114, shows numerals which correspond to those elements previously described. The detail of the threaded member 114 and the "T" member 116 through the hole 118 about the rivet 120 is explicitly illustrated.

Operation of FIGS. 9 and 10 only requires the threading of a bow release over the threaded member 114 of the bow string strap 100. Operation of the hand strap 102 is the same as that for the hand strap 12 of FIGS. 1–8. The bow string wrist strap 100 is usuable with any of the bow string release structures currently on the market which require a threaded member as the threaded rod 114 illustrated in FIGS. 9 and 10.

Various modifications can be made to the present invention without departing from the apparent scope thereof. The bow string release 10 and the wrist strap 100 of the figures can be used with any bow weight.

With regard to FIGS. 1–8, the steel plate can be a single plate with the ears spot welded or the like to the single thickness plate forming the aligned and opposing pivot holes. The thumb plate can be a threaded member of aluminum or the like twisted onto the threaded end of the hook for further locking the string into the press sleeve. This provides that the string, which should be in the range of 120 pound tensile strength, can be replaced if required. The threading of the thumb plate also provides for adjustment of the thumb plate with regard to the size of an individual's thumb.

Having thus described the invention, what is claimed is:

1. Bow string release for use by an archer with a bow including a bow string stretched between tips of said bow for shooting an arrow, said bow string release comprising:

a. strap including a hand strap, a front wrist strap, a rear wrist strap with a plurality of holes, a cross strap between said front and said hand strap, a roller clasp secured to said front wrist strap for securing said rear wrist strap;

b. a pivot pin, a steel plate being secured by said pivot pin at a front portion of said hand strap permitting a first degree of freedom, said steel plate being doubled over and including two opposing and aligned pivot holes permitting a second degree of freedom;

c. a release structure positioned on a cylindrical pin, said cylindrical pin rotatably mounted in said opposing and aligned pivot holes, said release structure including a press sleeve secured and affixed to said cylindrical pin and securing a hook member having a substantially right-angle hook at one end and a threaded member at the other end screwed through said press sleeve and an eyed closed-loop string extending beyond said hook; and, d. a thumb plate including a thumb pad screwed onto an overlapping end of said threaded hook member, said hook member protruding beyond said press sleeve permitting said eyed-string loop to extend around a bow string and over said hook member for pulling of a bow string, said hook member being maintained in position by an archer's thumb holding his thumb against said plate for subsequent drawing of said bow string back to a predetermined point for subsequent release of a bow string thereby shooting an arrow to a predetermined target at an accelerated departure velocity from said hook member of said bow string release.

2. Bow string release of claim 1 comprising covering over said thumb pad.

3. Bow string release of claim 2 wherein said covering material is velcro.

4. Bow string release of claim 2 wherein said covering is felt.

5. Bow string release of claim 1 wherein said strap comprises a closed "Y" leather strap and includes said roller clasp for accepting said strap having said plurality of holes, said clasp and said strap at opposing sides of said strap.

* * * * *